US008836248B2

(12) United States Patent
Verheijen

(10) Patent No.: US 8,836,248 B2
(45) Date of Patent: Sep. 16, 2014

(54) MONITORING A CONDITION OF A SOLID STATE CHARGE DEVICE IN ELECTROSTATIC PRINTING

(71) Applicant: Xerox Corporation, Norwalk, CT (US)

(72) Inventor: Hendrikus Adrianus Anthonius Verheijen, Helden (NL)

(73) Assignee: Xerox Corporation, Norwalk, CT (US)

( * ) Notice: Subject to any disclaimer, the term of this patent is extended or adjusted under 35 U.S.C. 154(b) by 143 days.

(21) Appl. No.: 13/687,363

(22) Filed: Nov. 28, 2012

(65) Prior Publication Data

US 2014/0147134 A1 May 29, 2014

(51) Int. Cl.
*G03G 15/02* (2006.01)
*G03G 15/00* (2006.01)

(52) U.S. Cl.
CPC ..... *G03G 15/55* (2013.01)
USPC ..... 315/502; 315/500; 315/501; 315/505; 399/31

(58) Field of Classification Search
USPC ..... 399/31; 315/500, 501, 502, 505
See application file for complete search history.

(56) References Cited

U.S. PATENT DOCUMENTS

| | | | | |
|---|---|---|---|---|
| 4,626,876 | A | 12/1986 | Miyagawa et al. | |
| 5,247,526 | A * | 9/1993 | Sabia et al. | 372/2 |
| 7,197,268 | B2 | 3/2007 | Verheijen | |
| 7,411,406 | B2 | 8/2008 | Verheijen | |
| 8,155,551 | B2 | 4/2012 | Verheijen et al. | |

* cited by examiner

*Primary Examiner* — David Gray
*Assistant Examiner* — Michael Harrison
(74) *Attorney, Agent, or Firm* — Hoffmann & Baron, LLP

(57) ABSTRACT

An apparatus to monitor a condition of a solid state charge device (SSCD) useful in electrostatic printing includes a power supply and a frequency detector. The power supply provides current to the SSCD, and includes a resonant controller. The frequency detector senses a frequency associated with the current, and since the frequency is representative of the condition of the SSCD, the frequency detector thereby monitors the condition of the SSCD. A method of monitoring the condition of the SSCD includes providing current to the SSCD using a power supply, and sensing a frequency associated with the current. The power supply includes a resonant controller, and the frequency is representative of the condition of the SSCD, and thus the method thereby monitors the condition of the SSCD. A corresponding computer-readable medium is also disclosed.

21 Claims, 7 Drawing Sheets

MONITORING A CONDITION OF A SOLID STATE CHARGE DEVICE IN ELECTROSTATIC PRINTING

TECHNICAL FIELD

The present disclosure relates to an apparatus for and method of monitoring a condition of a solid state charge device associated with an electrostatic printer.

BACKGROUND

Electrostatic or xerographic printers and copiers essentially operate in different stages including charging, exposure, developing, transferring, and fusing, as is well known. During the charging stage, a charge receptor or photoreceptor, typically in the form of a belt or cylindrical drum, is electrostatically charged with a high voltage wire, which is referred to as a corona wire, or a charge roller. The drum includes a coating of photoconductive material, which includes a semiconductor that becomes conductive when exposed to light. In many architectures there are provided multiple photoreceptor drums, one for each primary color used in the printing process. In other architectures, a single photoreceptor is charged, exposed, and developed at multiple stations, one for each primary color used in the printing process.

In order to generate an adequate amount of corona to initially charge the photoreceptor (hereinafter described as a cylindrical drum), each of the electrodes associated with solid state charge devices (SSCD), which are used to charge the cylindrical drum, is preferably energized. An aperture associated with the SSCD should also be in good condition and present low impedance to electrode current flowing thereto in order to generate a satisfactory corona. Issues with connections between a power supply associated with the copier and the SSCD or within the power supply often preclude an adequate corona. However, if these issues are detected, prints with reduced image quality may be reduced or eliminated. Monitoring the electrode current to the SSCD with a current sense resistor is one method for detecting these issues. However, due to the high frequency of the electrode current (such as about 100 kHz), such a detection circuit requires an amplifier with a relatively high slew rate, which adds significant cost and unreliability.

Accordingly, it would be desirable to provide a method and apparatus for effectively and efficiently monitoring the condition of SSCDs associated with electrostatic printers that overcome disadvantages of the prior art to permit high-quality copier output.

SUMMARY

According to aspects described herein, there is disclosed an apparatus to monitor a condition of a solid state charge device (SSCD) useful in electrostatic printing, which includes a power supply and a frequency detector. The power supply provides current to the SSCD, and includes a resonant controller. The frequency detector senses a frequency associated with the current, and since the frequency is representative of the condition of the SSCD, the frequency detector thereby monitors the condition of the SSCD.

The frequency detector may include a frequency-to-voltage converter, and may be operatively coupled to an output of the resonant controller. The power supply may include at least one of a transformer, field effect transistor, diode, inductor, power source, capacitor, switch, electrode, and/or resistor. The power supply may include electrodes, and the condition being monitored may include whether or not each of the electrodes has been energized. The resonant controller may include the frequency detector, and at least one of an application specific integrated circuit (ASIC), microcontroller, microprocessor, digital signal processor, digital logic, and/or memory. The frequency may include a switching frequency associated with the power supply, and the frequency detector may include a monostable multivibrator and a low-pass filter.

According to further aspects described herein, a method of monitoring a condition of a solid state charge device (SSCD) useful in electrostatic printing is disclosed herein, which includes providing current to the SSCD using a power supply, and sensing a frequency associated with the current. The power supply includes a resonant controller, and the frequency is representative of the condition of the SSCD, and thus the method thereby monitors the condition of the SSCD.

The sensing may include sensing the frequency at an output of the resonant controller, and the condition being monitored may include whether each of a plurality of electrodes has been energized. The resonant controller may include the frequency detector, and at least one of an application specific integrated circuit (ASIC), microcontroller, microprocessor, digital signal processor, digital logic, and/or memory. The sensing may include sensing a switching frequency associated with the power supply.

According to yet further aspects described herein, a computer-readable medium is disclosed, which includes instructions thereon that, when executed by a processing device, perform a method of monitoring a condition of a solid state charge device (SSCD) useful in electrostatic printing. The method includes providing current to the SSCD using a power supply, and sensing a frequency associated with the current. The power supply includes a resonant controller, and the frequency is representative of the condition of the SSCD, and thus the method thereby monitors the condition of the SSCD.

The sensing may include sensing the frequency at an output of the resonant controller, and the condition being monitored may include whether each of a plurality of electrodes has been energized. The resonant controller may include the frequency detector, and at least one of an application specific integrated circuit (ASIC), microcontroller, microprocessor, digital signal processor, digital logic, and/or memory. The sensing may include sensing a switching frequency associated with the power supply.

These and other aspects, objectives, features, and advantages of the disclosed technologies will become apparent from the following detailed description of illustrative embodiments thereof, which is to be read in connection with the accompanying drawings.

Figure 1:
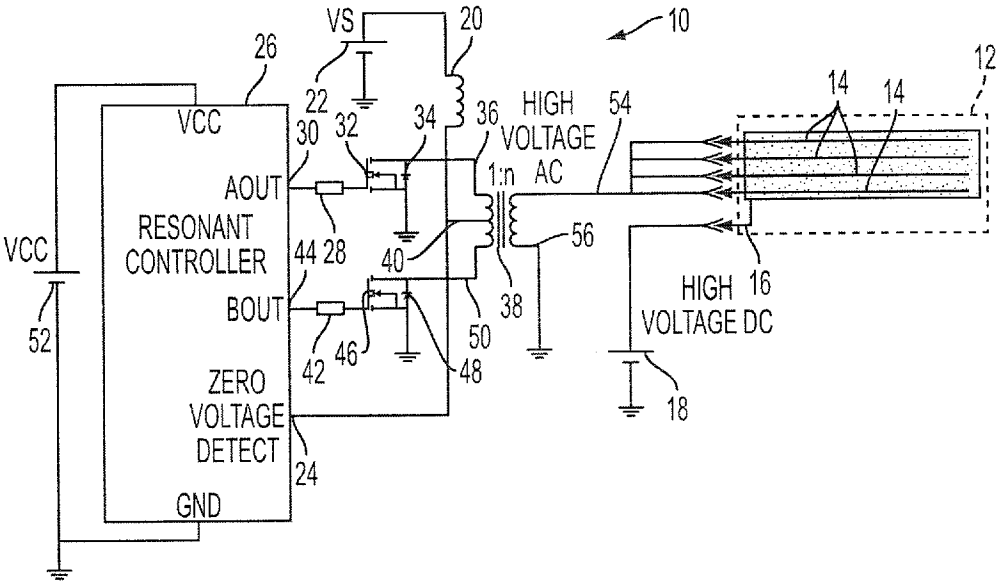
FIG. 1 is a schematic diagram of a power supply for driving a solid state charge device (SSCD) useful in electrostatic printing.

It is to be appreciated that elements in the figures are illustrated for simplicity and clarity. Common but well-understood elements that are useful in a commercially feasible embodiment are not shown in order to facilitate a less hindered view of the illustrated embodiments.

DETAILED DESCRIPTION

Describing now in further detail these exemplary embodiments with reference to the figures. The disclosed technologies improve the ability to monitor a condition of a solid state charge device (SSCD) associated with a electrostatic printer with little or no additional hardware.

As used herein, a "solid state charge device" or microtron is a type of particle accelerator, the concept for which originated from cyclotrons in which an accelerating field is not applied through large D-shaped electrodes, but through a linear accelerator structure. Kinetic energy of particles is increased in the microtron by a constant amount per field change. Microtrons are designed to operate at a constant field frequency and magnetic field, and are thus especially suited for very light elementary particles, such as electrons. In a microtron, due to different relativistic masses of electrons, the particle paths are different for each pass. The time needed for each pass is proportional to the pass number. Slower electrons need one electric field oscillation, and faster electrons an integer multiple of this oscillation. In contrast to most other accelerator concepts, microtrons provide high-energy electron beams with low beam emittance and high repetition rate.

As used herein, a "resonant controller" is a device used to monitor and sustain power supplied to an SSCD, such as a resonant lamp ballast controller, part number UC3872, which is commercially available from Texas Instruments, 12500 TI Boulevard, Dallas, Tex. 75243.

As used herein, the "slew rate" of an amplifier represents a maximum rate of change of the output voltage of the amplifier.

Embodiments disclosed herein are directed to monitoring a failure of a microtron or SSCD by sensing a frequency at which a power supply drives the SSCD. A change in frequency from a nominal value associated with the resonant controller to a different value indicates that the SSCD attached to the resonant controller has changed and that one or more electrodes associated with the SSCD are not being fully or adequately energized.

Benefits of the disclosed embodiments include the ability to sense failure of the SSCD with little or no additional hardware. For example, rather than requiring a series resistor and a high-slew rate amplifier to detect a presence of alternating current (AC) on a high-voltage side of a transformer, which is one indication of a failed SSCD, characteristics of the SSCD are sensed on a low-voltage side of the transformer. The embodiments disclosed herein provide for advantageous combination of a resonant controller for supplying power to an SSCD with use of frequency detection to monitor load and SSCD characteristics.

For resonant controllers, the switching frequency of the associated power supply is directly proportional to the load capacitance of the power supply. The SSCD electrode load is then predominantly capacitive, and each electrode contribution represents a portion of the total capacitance. The embodiments disclosed herein monitor the SSCD by measuring a switching frequency of the resonant controller. If the frequency is significantly higher than a predetermined normal frequency, which is measured when the SSCD is fully operational and all electrodes are fully energized, one or more electrodes are not fully or adequately energized. A frequency-to-voltage converter circuit may, for example, be used to monitor the switching frequency of the resonant controller. If the resonant controller is implemented using an application-specific integrated circuit (ASIC), microcontroller, or digital signal controller, the switching frequency can be monitored using software, thereby requiring no additional hardware to monitor load conditions.

FIG. 1 is a schematic diagram of a power supply 10 driving electrodes 14 coupled to a load or SSCD 12. The electrode current is sinusoidal. The frequency and magnitude of the electrode current depends on characteristics of the SSCD 12, such as, but not limited to, approximately 70 kHz and 500 mA. The electrode current is provided to each of the electrodes 14. If one or more of the electrodes 14 is not fully or adequately energized or activated, the electrode current will be reduced accordingly. For adequate charge uniformity on photoreceptors, such as a drum or belt, air in the proximity of each electrode is ionized uniformly along its full length. Thus, "fully energized", "adequately energized" or "fully activated", as used herein, refers to complete air ionization (or ozone generation) along the full length of the electrode. The electrode coupled between the aperture 16 and high-voltage DC source 18 of the power supply 10 preferably presents a low impedance to the high-frequency electrode current.

The power supply 10 also includes an inductor 20, which is coupled across a voltage supply VS 22 and a zero-voltage detect pin 24 of a resonant controller 26. A resistor 28 is coupled between an Aout output pin 30 of the resonant controller 26 and a field effect transistor (FET) or metal-oxide field effect transistor (MOSFET) 32. A diode 34 is coupled across source and drain terminals of the MOSFET 32, and a source terminal of the MOSFET 32 is coupled to ground. A drain terminal of the MOSFET 32 is coupled to a first terminal 36 of a transformer 38, and the zero-voltage detect pin 24 of the resonant controller 26 is coupled to a center tap terminal 40 of the transformer 38. A resistor 42 is coupled between a Bout output terminal 44 of the resonant controller 26 and a MOSFET 46. A diode 48 is coupled between source and drain terminals of the MOSFET 46, and a source terminal of the MOSFET 46 is coupled to ground. A drain terminal of the MOSFET 46 is coupled to a third terminal 50 of the transformer 38. The resonant controller 26 is powered by a voltage supply VCC 52. A first output terminal 54 of the transformer 38 is coupled to electrodes 14, and a second output terminal 56 of the transformer 38 is coupled to ground. A high-voltage DC power supply 18 is coupled between ground and the aperture 16 of the SSCD 12.

Figure 2:
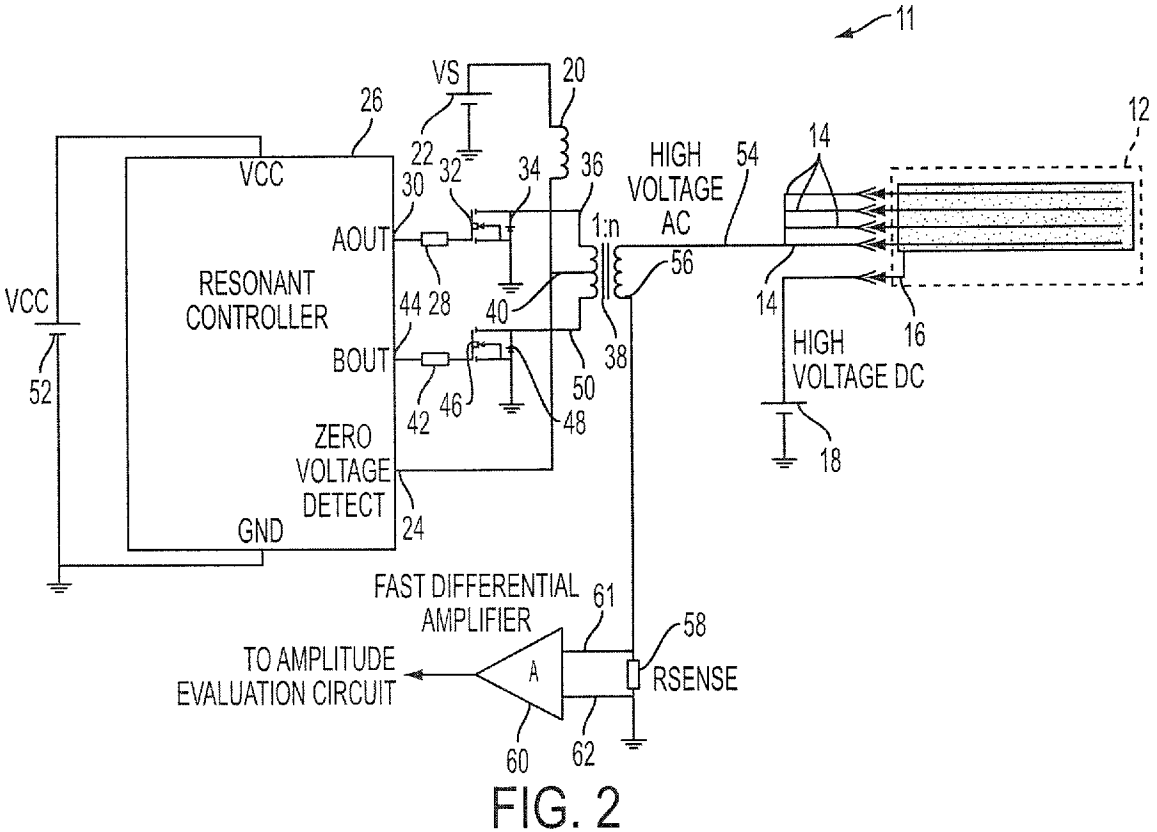
FIG. 2 is a schematic diagram of the power supply shown in FIG. 1, which includes a first embodiment of an electrode current measurement circuit.
Figure 3:
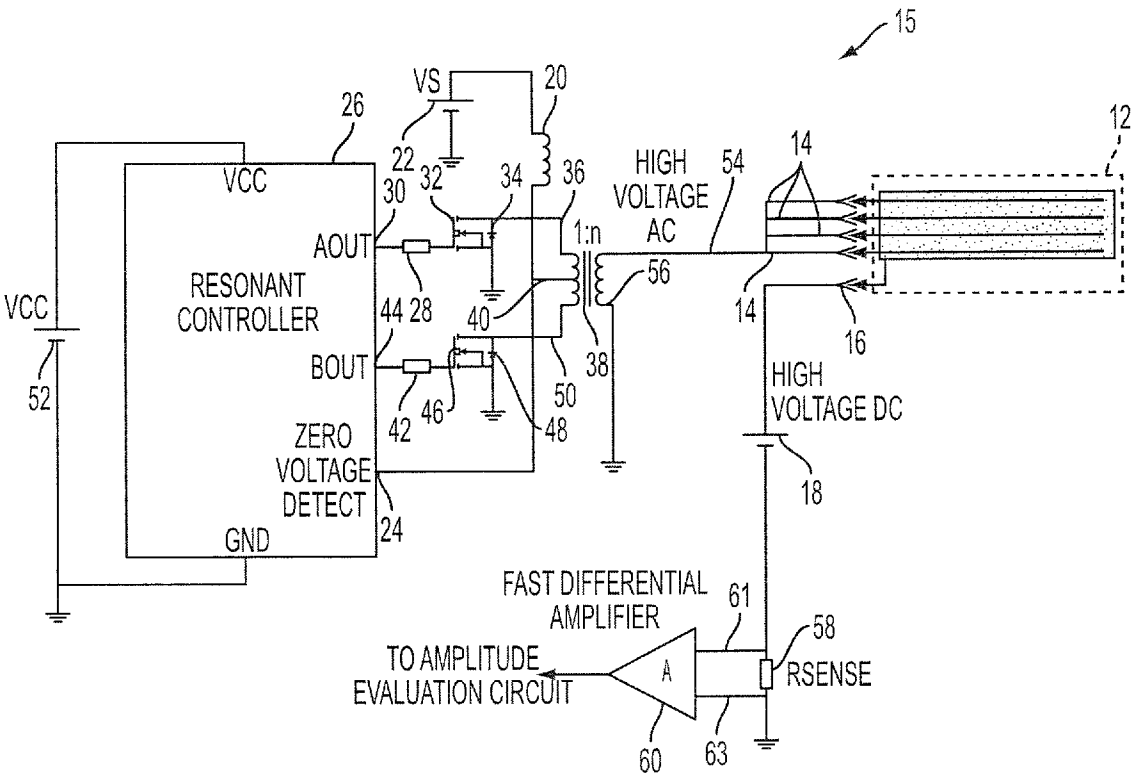
FIG. 3 is a schematic diagram of the power supply shown in FIG. 1, which includes a second embodiment of an electrode current measurement circuit.

FIGS. 2 and 3 are schematic diagrams of two embodiments of a circuit for implementing a current measurement to determine the amplitude of the electrode current. The embodiments shown in FIGS. 2 and 3 sense the electrode current in different branches of the respective circuits. Current leakage from high-voltage AC to a lower potential is monitored in the power supply 11 embodiment shown in FIG. 2, but not in the current sensing power supply 15 embodiment shown in FIG. 3, and thus the embodiment shown in FIG. 3 is preferred for monitoring load characteristics of the SSCD 12. The amplitude of the electrode current provides an indication of SSCD characteristics since the amplitude represents the capacitance of the SSCD at a given high-voltage AC level. For example, if one out of the four electrodes 14 is not energized, the amplitude of the electrode current is reduced by approximately 15%, as shown by the following analysis.

The electrode current I is provided by the following equation:

$$I=V\cdot j2\pi\cdot f_r C_L \quad (1),$$

where V represents electrode voltage, $f_r$ represents resonant frequency, and $C_L$ represents load capacitance. If the load capacitance $C_L$ is reduced by 25%, or is reduced to ¾$C_L$, then, according to the following equation, $$f_r \propto \frac{1}{\sqrt{C_L}}, \quad (2)$$

the resonant frequency changes to $f_r'$ as follows:

$$f_r' = \sqrt{\frac{4}{3}} \cdot f_r. \quad (3)$$

Thus, the resulting electrode current I' will be reduced as shown by the following equation:

$$\begin{aligned} I' &= V \cdot j2\pi \cdot f_r' C_L' \quad (4) \\ &= V \cdot j2\pi \cdot \sqrt{\frac{4}{3}} \cdot f_r \cdot \frac{3}{4} C_L \\ &= V \cdot j2\pi \cdot f_r C_L \cdot \sqrt{\frac{3}{4}}, \end{aligned}$$

and the resulting electrode current I', as compared to the original electrode current I, is as follows:

$$I' = \sqrt{\frac{3}{4}} \cdot I. \quad (5)$$

The power supply 11 shown in FIG. 2 is similar to that shown in FIG. 1, except that an additional resistor $R_{sense}$ 58 is coupled between the second output terminal 56 of the transformer 38 and ground, as well as across input terminals 61, 63 of a differential amplifier 60. A voltage level at an output of the differential amplifier 60 is used to determine the amplitude of the electrode current. The power supply 15 shown in FIG. 3 is similar to that shown in FIG. 2, except that the resistor $R_{sense}$ 58 is coupled across the high voltage DC power supply 18 and ground.

Resistor $R_{sense}$ 58 preferably has a low resistance value to limit power dissipation. To enable further processing and evaluation, the voltage across resistor $R_{sense}$ 58 is preferably amplified. For proper amplification, the differential amplifier 60 preferably exhibits a minimum slew rate, such as 5V/μs if the resonant frequency $f_r$ of the resonant controller 26 is approximately 100 kHz.

The resonant frequency $f_r$ is approximated by equation (6) as follows:

$$f_r \approx \frac{1}{2\pi n\sqrt{L_p(C_W + C_L)}}, \quad (6)$$

where $L_p$ represents a total primary inductance of the transformer 38, $C_w$ represents a secondary interwinding capacitance, and $C_L$ represents a capacitance of the load or SSCD 12. Additional parasitic capacitances resulting from the resonant controller 16 are negligible, and thus omitted for estimation purposes.

For a given transformer, variables associated with the transformer can be factored out, which results in equation (7) as follows:

$$f_r \propto \frac{1}{\sqrt{C_W + C_L}}. \quad (7)$$

Since the capacitance $C_w$ is a factor of 20 to 40 less than capacitance $C_L$, equation (8) is also valid to further approximate the resonant frequency $f_r$ as follows:

$$f_r \propto \frac{1}{\sqrt{C_L}}. \quad (8)$$

The embodiments herein utilize equations (6)-(8) by evaluating the switching frequency of the power supply, which is possible due to the switching and resonant frequencies of these embodiments being the same. Capacitance $C_L$ represents a sum of capacitances associated with electrodes 14. Thus, if one of the four (4) electrodes 14 is not energized, the resonant frequency increases by about 15%, as indicated by equation (3), and the electrode current decreases by about 15%, as indicated by equation (5).

Figure 4:
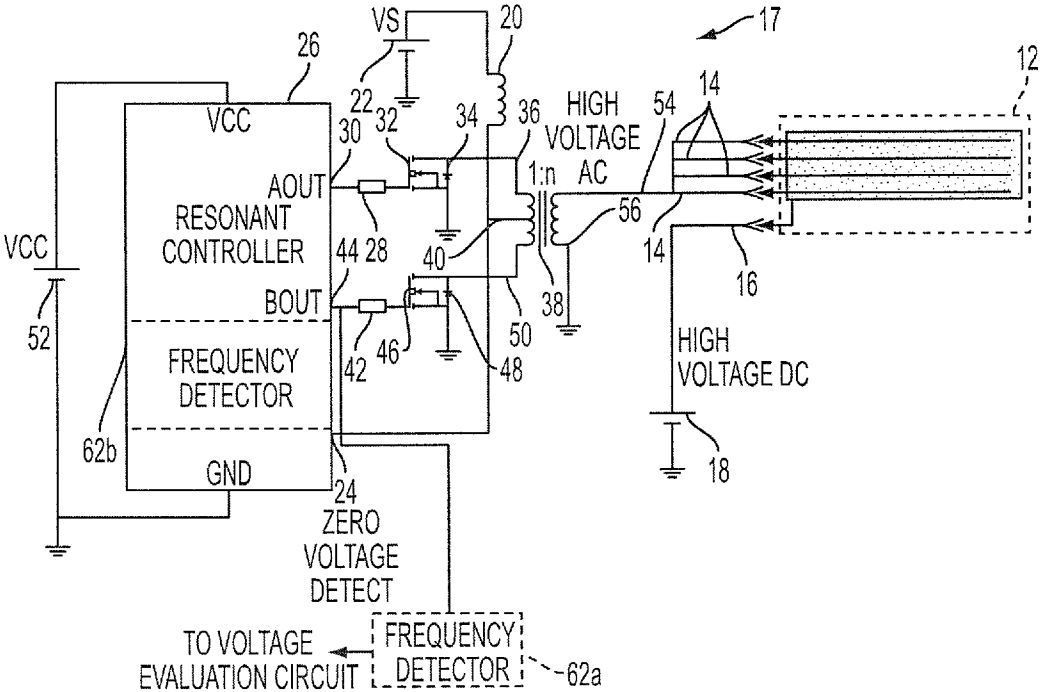
FIG. 4 is a schematic diagram of the power supply shown in FIG. 1, which including a first embodiment of a switching frequency measurement circuit.

FIG. 4 shows a schematic diagram of a power supply 17 for implementing a frequency measurement of the electrode current. The circuit in FIG. 4 is similar to that shown in FIG. 3, except that the resistor $R_{sense}$ 58 and differential amplifier 60 have been omitted and a frequency detector or frequency-to-voltage converter 62*a* has been added. The frequency-to-voltage converter 62*a* is connected to the Bout output terminal 44 of the resonant controller 26. The voltage level at an output of the frequency-to-voltage converter 62*a* is used to determine the frequency of the electrode current.

The frequency-to-voltage converter 62*a* may be implemented using a monostable multivibrator (one-shot) circuit (not shown), followed by a low-pass filter (not shown). Although shown in FIG. 4 as being coupled to the $B_{out}$ output terminal 44, the frequency-to-voltage converter 62*a* may be triggered by either of the two gate drive signals, that is, the $A_{out}$ output terminal 30 or the $B_{out}$ output terminal 44, of the resonant controller 26 via coupling thereto.

Alternatively, the switching frequency of the electrode current may be monitored by the resonant controller 26, as shown by a frequency detector 62*b* in dashed lines within the resonant controller of FIG. 4, in which case additional external hardware is not required. As indicated above, an ASIC, digital signal controller, and/or microcontroller may be used to implement the resonant controller 26 to realize such an embodiment. The use of dashed lines in FIG. 4 is intended to represent alternative embodiments of, for example, the frequency detectors 62*a,b*.

High-voltage AC current is applied to the electrodes 14 to produce a corona using the SSCD 12. The embodiments disclosed herein can generate this high voltage in a very efficient and cost-effective manner by utilizing a current-fed, zero-voltage, switching, resonant controller while maintaining low power loss and electromagnetic interference. The components used to implement the embodiments herein enable a compact design and point-of-load architecture (POL). POL architectures solve the challenge of high peak current demands and low noise margins presented by high-performance semiconductors, such as microcontrollers or ASICs, by placing individual power supply regulators (linear or DC-DC) in close proximity with their point-of-use.

The electrode voltage required to generate a corona depends on the characteristics of the particular SSCD used, such as a sine wave with a peak-to-peak voltage of approximately 2.5 kVpp and a frequency of about 70 kHz. SSCDs present a load to the power supply, which is primarily capacitive, such as about 1.5 nF. As a result, the relatively high voltage and frequency generated by the power supply in generating the corona causes a high capacitive current.

Power supply topologies are capable of generating a required signal for such a load. However, if such a power supply is intended for production, that power supply must be efficient, reliable, readily manufacturable, compact, and cost-efficient, with low electromagnetic emissions. The embodiments disclosed herein include these beneficial characteristics.

Figure 5:
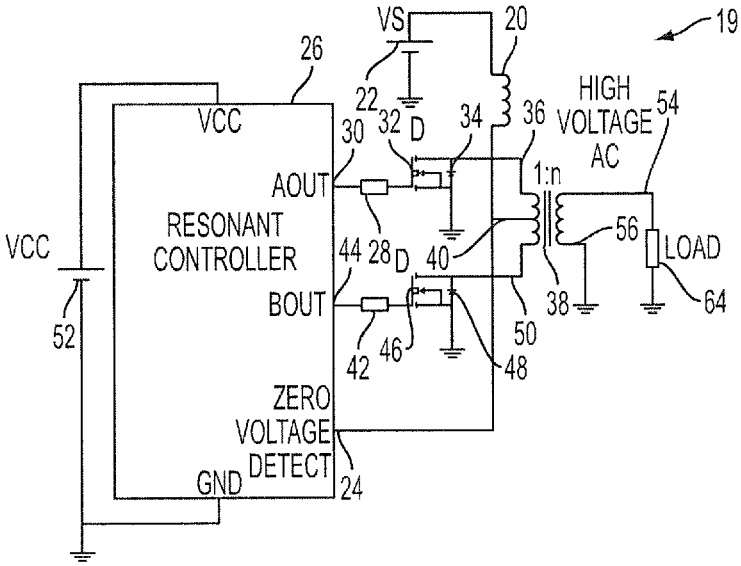
FIG. 5 is a schematic diagram of a current-fed, zero-voltage, switched resonant controlled power supply.

A current-fed, zero-voltage, switched, resonant controller power supply is a highly efficient conversion topology for driving capacitive loads. Such a power supply 19 includes a push-pull MOSFET driver, inductor 20, transformer 38 with center-tap 40, and resonant controller 26 as shown in FIG. 5. The power supply 19 is similar to the power supply 17 shown in FIG. 4, except that the frequency-to-voltage converters 62*a,b* and high-voltage DC power supply 18 have been omitted. As discussed above, functions of the resonant controller 26 may be made available as an integrated circuit to reduce component count and area requirements.

The controller 26 is driven at its resonant frequency to provide zero-voltage switching operation. The push-pull output MOSFETs 28, 42 are alternatively driven at a 50% duty cycle. Commutation occurs as the MOSFET 28, 42 drain voltages resonate through zero, thereby ensuring zero-voltage switching. This feature virtually eliminates switching losses. Electrode current is supplied to the push-pull stage by voltage source $V_S$ 22 in conjunction with inductor 20. The resonant frequency $f_r$ is determined by the inductance of the transformer 38 primary and the effective capacitance or parallel resonance across the transformer 38 primary. The effective capacitance includes the capacitance associated with the transformer 38 primary in addition to the capacitance reflected from the transformer 38 secondary. This secondary capacitance includes capacitance of the winding and the load or SSCD 12. The capacitance of the transformer 38 secondary is coupled to the transformer 38 primary in proportion to a square of the turns ratio n. Since the load capacitance represents a portion of a resonant tank circuit, the load capacitance determines the resonant frequency $f_r$.

The voltage of the transformer 38 primary, which is equal to the differential voltage between drain terminals of the MOSFETs 32, 46, is a symmetrical sine wave with a peak-to-peak value equal to $2\pi V_S$. The transformer 38 secondary exhibits a symmetrical sine wave with a peak-to-peak voltage of $2\pi V_S$. Thus, the output voltage may be varied by adjusting the supply voltage $V_S$ 22.

When the electrode voltage is below the level required to generate a corona, the load may be represented by a capacitance with a very low equivalent series resistance (ESR), as compared with a reactance of the SSCD 12. If additional electrodes are added in parallel, the capacitance increases and the ESR decreases. However, for estimation purposes, the ESR may be neglected. Geometric capacitance is formed by a coronode opposed the electrodes having a dielectric layer therebetween. That is, a capacitance can be referred to as a geometric capacitance since capacitance is a function of the physical dimensions of the associated conductors and permittivity of the associated dielectric. However, when dealing with SSCDs, air functions as the dielectric and the capacitance is a function of the ionization level of air. As the size of the aperture increases, the geometric capacitance decreases.

Figure 6:
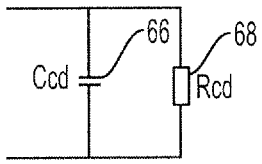
FIG. 6 is an equivalent circuit model of the SSCD.

When the electrode voltage is high enough to generate the corona, the load or SSCD 12 can be modeled by a capacitor $C_{cd}$ 66 in parallel with a resistor $R_{cd}$ 68, as shown in FIG. 6. Due to the corona discharge, the values of both the capacitor $C_{cd}$ 66 and resistor $R_{cd}$ 68 are non-linear. The current through resistor $R_{cd}$ 68 simulates resistive current that is enabled by the corona discharge.

The transformer 38 turns ratio n and inductance are preferably selected to provide the appropriate output voltage and resonant frequency required for the SSCD 12. Neglecting losses due to the resonant controller 26, only the resistive portion of the SSCD 12 ($R_{cd}$) results in voltage supply $V_S$ 22 sourcing current. A characteristic of a lossless resonant controller 26 is that the controller 26 consumes no current if the load is reactive. Therefore, only the resistive portion of the load will cause current consumption.

The resonant controller 26 may be implemented using a resonant lamp ballast controller (part number UC3872, which is commercially available from Texas Instruments, 12500 TI Boulevard, Dallas, Tex. 75243). The resonant controller 26 is primarily intended for driving a cold cathode fluorescent lamp (CCFL) for liquid crystal diode (LCD) back-lighting. In addition to controller functions, the UC3872 includes a Buck controller for lamp intensity adjustment. The SSCD 12 uses a regulated voltage capable of adjustment, which is generated by the voltage source $V_S$ 22. Additional features in the resonant controller 26 include soft-start and open lamp detection. The soft-start feature enables the SSCD voltage to ramp up in a controlled manner when switched on. This feature prevents overshoot, which can cause damage to the SSCD 12 from arcing. The open lamp detection feature is intended to detect zero current in a current controlled regulator. In a voltage controlled scheme, this feature results in zero-voltage detection, and thus serves as a short-circuit or over-current detector.

Figure 7:
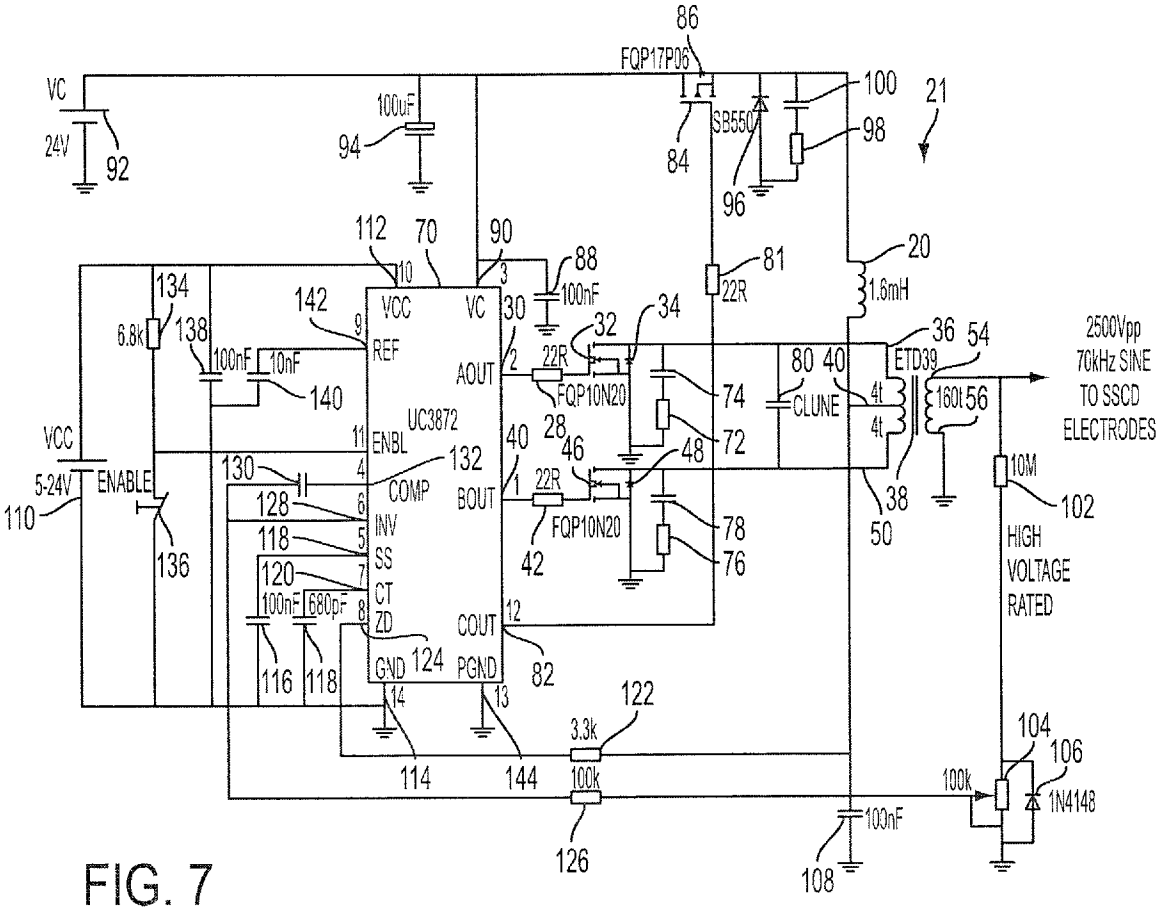
FIG. 7 is a schematic diagram of a second embodiment of a power supply in accordance with features disclosed herein.

FIG. 7 is a schematic diagram of an embodiment of a power supply 21. As in FIGS. 1-5, resistor 28 is coupled between the Aout pin 30 and MOSFET 32, and diode 34 is coupled between source and drain terminals of MOSFET 32. Diode 48 is coupled across source and drain terminals of MOSFET 48, and resistor 42 is coupled between the Bout terminal 40 of the resonant controller 70 and MOSFET 46. Resistor 72 and capacitor 74 are coupled in series across source and drain terminals of MOSFET 32, and resistor 76 and capacitor 78 are coupled in series across source and drain terminals of MOSFET 46. The source terminals of MOSFETs 32, 46 are coupled to ground. Capacitor $C_{tune}$ 80 is coupled across drain terminals of MOSFETs 32, 46, as well as terminals 36, 50 of transformer 38. Resistor 81 is coupled between Cout terminal 82 of controller 70 and MOSFET 84, the source and drain terminals of which are coupled across diode 86. Capacitor 88 is coupled across ground and a $V_c$ terminal 90 of the controller 70, which is coupled to a power supply VC 92. Capacitor 94 is coupled across the power supply 92 and ground, and diode 96 is coupled across the source terminal of MOSFET 84 and ground. Resistor 98 and capacitor 100 are coupled in series across diode 96, and resistor 102 and potentiometer 104 are coupled in series across terminal 54 of transformer 38 and ground. Diode 106 is coupled across potentiometer 104. Inductor 20 and capacitor 108 are coupled in series across diode 96, and terminal 40 of transformer 38 is coupled to a point between inductor 20 and capacitor 108. Power supply 110 is coupled across a VCC terminal 112 and GND terminal 114 of the controller 70. Capacitor 116 is coupled between an SS terminal 118 of the controller 70 and ground, and capacitor 118 is coupled between a CT terminal 120 of the controller 70 and ground. Resistor 122 is coupled between a ZD terminal 124 of controller 70 and terminal 40 of transformer 38, and resistor 126 is coupled between an INV terminal 128 of the controller 70 and potentiometer 104. Capacitor 130 is coupled between a COMP terminal 132 of the controller 70 and an INV terminal 128 of the controller 70. Resistor 134 and enable switch 136 are coupled in series across VCC terminal 112 of controller 70 and ground, and capacitor 138 is coupled across VCC terminal 112 of controller 70 and ground. Capacitor 140 is coupled between a REF terminal 142 of controller 70 and ground, and a PGND terminal 144 of controller 70 is coupled to ground.

The potentiometer 104 enables the output voltage of the power supply 21 to be set using voltage feedback. The three MOSFETs 28, 42, 84 are preferably in TO-220 packages and the Schottky diodes 34, 48, 96 are in axial type packages. The semiconductors do not require forced cooling or heatsinks. The switching frequency of the Buck converter, which includes MOSFET 84, diode 96, resistor 98, and capacitor 100, is synchronized with the resonant frequency for elimination of beat frequencies. Capacitor $C_{tune}$ 80 may be used to tune the resonant frequency. However, capacitor $C_{tune}$ 80 may be omitted by selecting the inductance of transformer 38. Optimization of the power supply 21 is dependant on the transformer 28 selected for implementation. Copper diameters are preferably large enough to limit losses caused by relatively high resonant current, which is application dependant. For example, a primary Litz cable can include 240 strands having a diameter of 0.1 mm. The total diameter of the cable is then approximately 2 mm. On the secondary side of the transformer, cable having 12 strands of 0.1 mm diameter wire can be used, which results in a cable having an approximately 0.5 mm total diameter.

Due to a skin effect, Litz wire should be used. The skin effect refers to the tendency of an alternating electric current to become distributed within a conductor such that the current density is largest near the surface of the conductor, and decreases with greater depths in the conductor. The electric current flows mainly at the skin of the conductor, between the outer surface and a level referred to as the skin depth. The skin effect causes the effective resistance of the conductor to increase at higher frequencies where the skin depth is lower, thus reducing the effective cross-section of the conductor. The skin effect is caused by opposing eddy currents induced by a changing magnetic field resulting from the alternating current. At 60 Hz in copper, the skin depth is about 8.5 mm. At high frequencies, the skin depth becomes much smaller. Increased AC resistance due to the skin effect can be mitigated by using specially woven Litz wire. Because the interior of a large conductor carries so little of the current, tubular conductors, such as pipe can be used to save weight and cost.

Litz wire is a type of cable used in electronics to carry alternating current. Litz wire is designed to reduce skin effect and proximity effect losses in conductors used at frequencies up to about 1 MHz. Litz wire includes many thin wire strands, individually insulated and twisted or woven together, following one of several carefully prescribed patterns often involving several levels or groups of twisted wires that are twisted together. This winding pattern equalizes the proportion of the overall length over which each strand is at the outside of the conductor.

The winding capacitance is preferably maintained at a low value to avoid rendering the tank impedance unnecessarily low. In order to limit core losses, the core material is preferably suitable for relatively high frequency power transfer. The MOSFETs 32, 46, 84 are preferably fast-switching, with a low drain-to-source resistance $R_{ds}$ value. RC snubber networks are placed across Schottky diode 96 and resonant MOSFETs 32 and 46 to suppress ringing effects. RC snubber networks include capacitor 100 and resistor 98 across Schottky diode 96, capacitor 74 and resistor 72 across MOSFET 32, and capacitor 78 and resistor 76 across lower MOSFET 46.

The circuit shown in FIG. 7 exhibits 70% efficiency when loaded with the SSCD 12 and the electrode current is 2500 Vpp and 70 kHz. The rms value of the electrode current is approximately 550 mA. Core and copper losses are predominant. That is, from all losses involved that reduce the efficiency to about 70%, the core and copper losses account for the largest portion. Other losses are switch and conduction losses of the semiconductors and losses in the RC snubber networks. The efficiency can be improved by using a different core material and/or choosing a larger transformer. Further improvement may be achieved through semiconductor selection. A larger transformer core (with a larger cross-sectional area) will have lower losses. Also, selection of transformer core materials provides for different loss characteristics. For further efficiency improvement, the DC and AC resistance of the windings can be reduced by using thicker Litz cable with more strands, which will require a larger coil former to make the Litz cable fit in the coil former. Semiconductor components exhibit switching and conduction characteristics that influence power dissipation, and thus may be selected to adjust power dissipation.

Alternative power supply topologies that are capable of driving the electrodes have fewer advantages than the embodiments disclosed herein. Non-resonant power conversion techniques are not as efficient, occupy a greater amount of space, and are relatively expensive to manufacture. Self-resonant topologies, such as Royer oscillators, may exhibit problems with obtaining accurate and reliable transistor DC biasing over the required voltage range, which may result in distortion, amplitude problems, and/or high transistor currents. The embodiments herein are compact, thereby enabling point-of-load architecture, which is very beneficial since it prevents additional wiring capacitance and corona effects caused by these wires carrying high voltages at high frequencies. The aperture is preferably coupled to a DC voltage have a range of approximately 600V. The SSCD's aperture connection is coupled to a high-voltage DC source. When the electrodes are energized, the corona makes the air conductive. This is represented by resistor Rcd 68 in FIG. 6, which serves as a DC path for the DC source. In this way charged particles are transferred from the DC source to the photoreceptor. The DC voltage determines the charging level of the photoreceptor. The voltage on the photoreceptor will be approximately equal to the DC source voltage. A typical value is 600V, however, the exact value, which may be negative, depends on the requirements of the electrostatic system.

Thus, the embodiments herein supply the electrode voltage required to generate a corona using an SSCD in a way that is able to compensate for variations in SSCD characteristics, while being more compact, efficient, reliable, and cost-effective than existing topologies. The embodiments herein can also be used in applications requiring high sinusoidal voltages across capacitive loads to provide efficient and cost effective methods for generating AC corona voltages.

Figure 8:
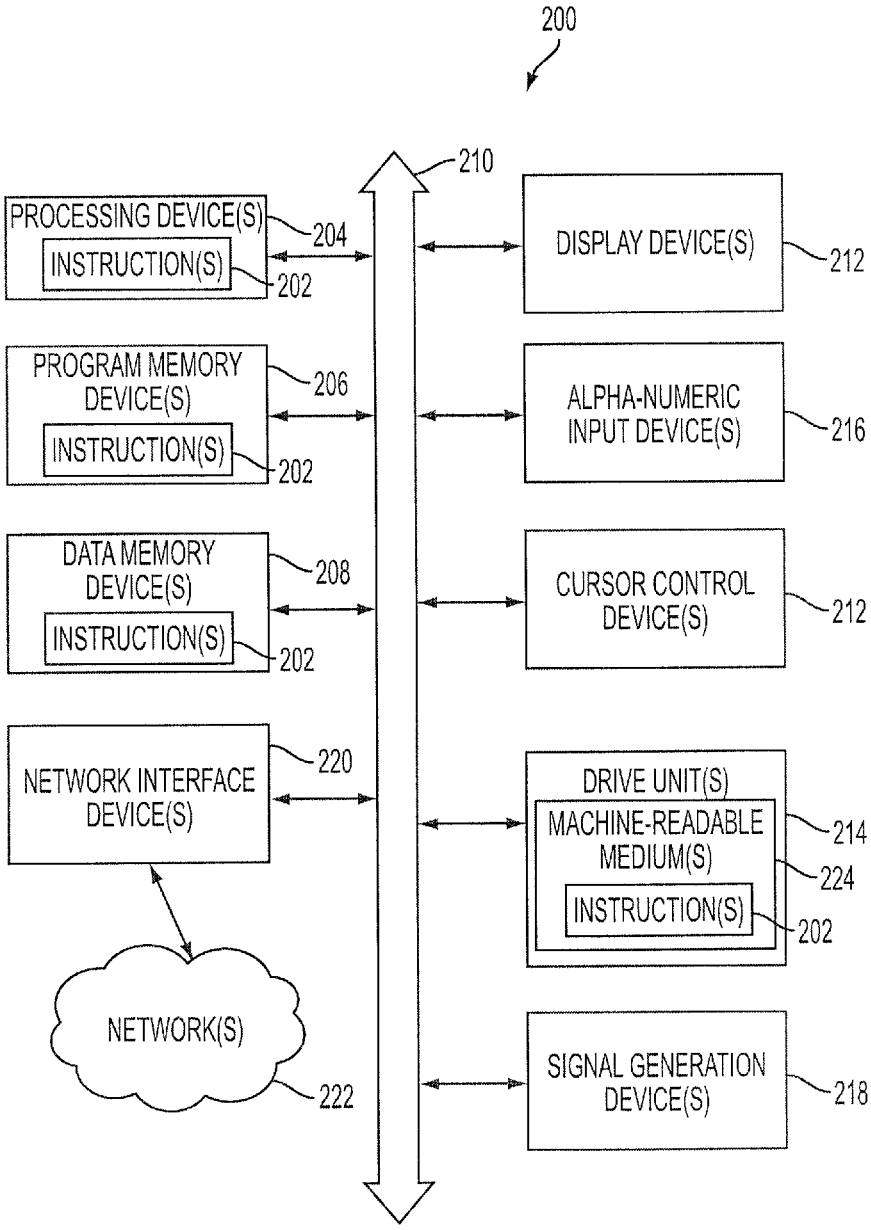
FIG. 8 is a block diagram showing at least a portion of an exemplary machine in the form of a computing system configured to perform methods disclosed herein according to embodiments of the invention.

FIG. 8 is a block diagram depicting at least a portion of an exemplary machine in the form of a computing system 200 configured to perform the disclosed methods, according to an embodiment of the invention. The computing system 200 includes a set of instructions 202 that, when executed, causes the system to perform any one or more of the methodologies according to embodiments of the invention. In some embodiments, the computing system 200 operates as a standalone device. In some embodiments, the computing system 200 is coupled (e.g., using a network) with other systems and/or devices. In a networked implementation, the system 200 operates in the capacity of a server or a client user machine in a server-client user network environment. The computing system 200 may comprise, for example, one or more of a server computer, a client user computer, a personal computer (PC), a tablet PC, a Personal Digital Assistant (PDA), a cellular telephone, a mobile device, a palmtop computer, a laptop computer, a desktop computer, a communication device, a personal trusted device, a web appliance, a network router, a switch or bridge, or any apparatus capable of executing a set of instructions (sequential or otherwise) that specify actions to be taken by that apparatus.

The computing system 200 includes a processing device(s) 204 (e.g., a central processing unit (CPU), a graphics processing unit (GPU), or both), program memory device(s) 206, and data memory device(s) 208, which communicate with each other via a bus 210. The computing system 200 further includes display device(s) 212 (e.g., liquid crystal display (LCD), a flat panel, a solid state display, or a cathode ray tube (CRT)). The computing system 200 includes input device(s) 216 (e.g., a keyboard), cursor control device(s) 212 (e.g., a mouse), disk drive unit(s) 214, signal generation device(s) 218 (e.g., a speaker or remote control), and network interface device(s) 220.

The disk drive unit(s) 214 includes machine-readable medium(s) 224, on which is stored one or more sets of instructions 202 (e.g., software) embodying any one or more of the methodologies or functions disclosed herein, including those methods disclosed herein. The instructions 202 also resides, completely or at least partially, within the program memory device(s) 206, the data memory device(s) 208, and/or within the processing device(s) 204 during execution thereof by the computing system 200. The program memory device(s) 206 and the processing device(s) 204 also constitute machine-readable media. Dedicated hardware implementations 204, such as but not limited to application specific integrated circuits, programmable logic arrays, and other hardware devices can likewise be constructed to implement the methods described herein. Applications that include the apparatus and systems of various embodiments broadly include a variety of electronic and computer systems. Some embodiments implement functions in two or more specific interconnected hardware modules or devices with related control and data signals communicated between and through the modules, or as portions of an application-specific integrated circuit. Thus, the example system is applicable to software, firmware, and hardware implementations.

In accordance with various embodiments, the methods, functions or logic described herein are implemented as one or more software programs running on a computer processor. Dedicated hardware implementations including, but not limited to, application specific integrated circuits, programmable logic arrays and other hardware devices can likewise be constructed to implement the methods described herein. Furthermore, alternative software implementations including, but not limited to, distributed processing or component/object distributed processing, parallel processing, or virtual machine processing can also be constructed to implement the methods, functions or logic described herein.

The present embodiment contemplates a machine-readable medium or computer-readable medium containing instructions 202, or that which receives and executes instructions 202 from a propagated signal so that a device coupled with a network environment 222 can send or receive voice, video or data, and to communicate over the network 222 using the instructions 202. The instructions 202 are transmitted or received over a network 222 via the network interface device (s) 220. The machine-readable medium also contains a data structure for storing data useful in providing a functional relationship between the data and a machine or computer in an illustrative embodiment of the disclosed systems and methods.

While the machine-readable medium 224 is shown in an example embodiment to be a single medium, the term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding, or carrying a set of instructions for execution by the machine and that cause the machine to perform anyone or more of the methodologies of the present embodiment. The term "machine-readable medium" shall accordingly be taken to include, but not be limited to: solid-state memories such as a memory card or other package that houses one or more read-only (non-volatile) memories, random access memories, or other re-writable (volatile) memories; magneto-optical or optical medium such as a disk or tape; and/or a digital file attachment to e-mail or other self-contained information archive or set of archives is considered a distribution medium equivalent to a tangible storage medium. Accordingly, the embodiment is considered to include anyone or more of a tangible machine-readable medium or a tangible distribution medium, as listed herein and including art-recognized equivalents and successor media, in which the software implementations herein are stored.

It should also be noted that software which implements the disclosed methods, functions or logic are stored on a tangible storage medium, such as: a magnetic medium, such as a disk or tape; a magneto-optical or optical medium, such as a disk; or a solid state medium, such as a memory card or other package that houses one or more read-only (non-volatile) memories, random access memories, or other re-writable (volatile) memories. A digital file attachment to e-mail or other self-contained information archive or set of archives is considered a distribution medium equivalent to a tangible storage medium. Accordingly, the disclosure is considered to include a tangible storage medium or distribution medium as listed herein, and other equivalents and successor media, in which the software implementations herein are stored.

Although the present specification describes components and functions implemented in the embodiments with reference to particular standards and protocols, the disclosed embodiment are not limited to such standards and protocols.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments are utilized and derived therefrom, such that structural and logical substitutions and changes are made without departing from the scope of this disclosure. Figures are also merely representational and are not drawn to scale. Certain proportions thereof are exaggerated, while others are reduced. Accordingly, the specification and drawings are to be regarded in an illustrative rather than a restrictive sense.

Such embodiments of the inventive subject matter are referred to herein, individually and/or collectively, by the term "embodiment" merely for convenience and without intending to voluntarily limit the scope of this application to any single embodiment or inventive concept if more than one is in fact disclosed. Thus, although specific embodiments have been illustrated and described herein, it should be appreciated that any arrangement calculated to achieve the same purpose is substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate example embodiment.

The Abstract is provided to comply with 37 C.F.R. §1.72 (b), which requires an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description of Preferred Embodiments, with each claim standing on its own as separately claimed subject matter.

Although specific example embodiments have been described, it will be evident that various modifications and changes are made to these embodiments without departing from the broader scope of the inventive subject matter described herein. Accordingly, the specification and drawings are to be regarded in an illustrative rather than a restrictive sense. The accompanying drawings that form a part hereof, show by way of illustration, and without limitation, specific embodiments in which the subject matter is practiced. The embodiments illustrated are described in sufficient detail to enable those skilled in the art to practice the teachings disclosed herein. Other embodiments are utilized and derived therefrom, such that structural and logical substitutions and changes are made without departing from the scope of this disclosure. This Detailed Description, therefore, is not to be taken in a limiting sense, and the scope of various embodiments is defined only by the appended claims, along with the full range of equivalents to which such claims are entitled.

Given the teachings of the invention provided herein, one of ordinary skill in the art will be able to contemplate other implementations and applications of the techniques of the invention. Although illustrative embodiments of the invention have been described herein with reference to the accompanying drawings, it is to be understood that the invention is not limited to those precise embodiments, and that various other changes and modifications are made by one skilled in the art without departing from the scope of the appended claims.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. An apparatus to monitor a load capacitance of a solid state charge device (SSCD) useful in electrostatic printing, the apparatus comprising:

a power supply, the power supply providing current to the SSCD, the power supply comprising a resonant controller; and a frequency detector, the frequency detector measuring a frequency associated with the current, the frequency being representative of the load capacitance of the SSCD, the frequency detector thereby monitoring the load capacitance of the SSCD to sense failure of the SSCD.

2. The apparatus, as defined by claim 1, wherein the frequency detector further comprises a frequency-to-voltage converter operatively coupled to the current.

3. The apparatus, as defined by claim 1, wherein the frequency detector is operatively coupled to an output of the resonant controller.

4. The apparatus, as defined by claim 1, wherein the power supply further comprises at least one of a transformer, field effect transistor, diode, inductor, power source, capacitor, switch, electrode, and resistor operatively coupled to the current.

5. The apparatus, as defined by claim 1, wherein the SSCD further comprises electrodes operatively coupled to the current, the load capacitance being monitored indicating whether each of the electrodes is fully energized.

6. The apparatus, as defined by claim 1, wherein the resonant controller comprises the frequency detector.

7. The apparatus, as defined by claim 1, wherein the resonant controller comprises at least one of an application specific integrated circuit (ASIC), microcontroller, microprocessor, digital signal processor, digital logic, and memory operatively coupled to the current.

8. The apparatus, as defined by claim 1, wherein the frequency comprises a switching frequency associated with the power supply.

9. The apparatus, as defined by claim 1, wherein the frequency detector further comprises a monostable multivibrator and a low-pass filter operatively coupled to the current.

10. A method of monitoring a load capacitance of a solid state charge device (SSCD)) useful in electrostatic printing, the method comprising:

providing current to the SSCD using a power supply, the power supply comprising a resonant controller; and measuring a frequency associated with the current, the frequency being representative of the load capacitance of the SSCD, thereby monitoring the load capacitance of the SSCD to sense failure of the SSCD.

11. The method, as defined by claim 10, wherein sensing the frequency further comprises sensing the frequency at an output of the resonant controller.

12. The method, as defined by claim 10, wherein the load capacitance being monitored indicates whether each of a plurality of electrodes associated with the SSCD is fully energized, the electrodes being operatively coupled to the current.

13. The method, as defined by claim 10, wherein the resonant controller comprises the frequency detector.

14. The method, as defined by claim 10, wherein the resonant controller comprises at least one of an application specific integrated circuit (ASIC), microcontroller, microprocessor, digital signal processor, digital logic, and memory operatively coupled to the current.

15. The method, as defined by claim 10, wherein sensing the frequency comprises sensing a switching frequency associated with the power supply.

16. A non-transitory computer-readable medium comprising instructions thereon that, when executed by a processing device, perform a method of monitoring a load capacitance of a solid state charge device (SSCD)) useful in electrostatic printing, the method comprising:

providing current to the SSCD using a power supply, the power supply comprising a resonant controller; and measuring a frequency associated with the current, the frequency being representative of the load capacitance of the SSCD, thereby monitoring the condition load capacitance of the SSCD to sense failure of the SSCD.

17. The non-transitory computer-readable medium, as defined by claim 16, wherein sensing the frequency further comprises sensing the frequency at an output of the resonant controller.

18. The non-transitory computer-readable medium, as defined by claim 16, wherein the load capacitance being monitored indicates whether each of a plurality of electrodes associated with the SSCD is fully energized, the electrodes being operatively coupled to the current.

19. The non-transitory computer-readable medium, as defined by claim 16, wherein the resonant controller comprises the frequency detector.

20. The non-transitory computer-readable medium, as defined by claim 16, wherein the resonant controller comprises at least one of an application specific integrated circuit (ASIC), microcontroller, microprocessor, digital signal processor, digital logic, and memory operatively coupled to the current.

21. The non-transitory computer-readable medium, as defined by claim 16, wherein sensing the frequency comprises sensing a switching frequency associated with the power supply.

* * * * *